US005089676A

United States Patent [19]

Duncan

[11] Patent Number: 5,089,676

[45] Date of Patent: Feb. 18, 1992

[54] LIQUID LEVEL FLOAT SWITCH

[75] Inventor: Malcolm Duncan, Lisle, Ill.

[73] Assignee: Magnetrol International Incorporated, Downers Grove, Ill.

[21] Appl. No.: 523,972

[22] Filed: May 16, 1990

[30] Foreign Application Priority Data

May 16, 1989 [ZA] South Africa ..... 89/3624

[51] Int. Cl.[5] ..... H01H 35/18

[52] U.S. Cl. ..... 200/84 R; 73/313; 200/61.45 M; 340/625; 417/40

[58] Field of Search ..... 417/40; 307/118; 340/623-625; 73/308, 313, 318; 200/61.2, 61.52, 61.45 R, 61.45 M, 84 R, 84 C

[56] References Cited

U.S. PATENT DOCUMENTS

| | | | |
|---|---|---|---|
| 3,483,341 | 12/1969 | Reichensperger | 200/84 R |
| 3,864,538 | 2/1975 | Paradis et al. | 200/84 |
| 3,944,770 | 3/1976 | Pepper | 200/84 |
| 4,021,194 | 5/1977 | Matsusaka | 417/40 |
| 4,262,216 | 4/1981 | Johnston | 307/118 |
| 4,302,641 | 11/1981 | Johnston | 200/84 |
| 4,321,438 | 3/1982 | Emenegger | 200/61.45 R |
| 4,373,155 | 2/1983 | Dola | 340/623 |
| 4,629,841 | 12/1986 | Riback et al. | 200/153 |
| 4,644,117 | 2/1987 | Grimes et al. | 200/84 |
| 4,917,135 | 4/1990 | Duncan | 200/84 R |

FOREIGN PATENT DOCUMENTS

| | | | |
|---|---|---|---|
| 1073558 | 6/1967 | United Kingdom | 200/84 R |

OTHER PUBLICATIONS

FLYGT brochure ENH 10.02.07.Eng. 4M.7.85 "EN-H-10 Controlling the liquid level".

*Primary Examiner*—Gerald P. Tolin

*Attorney, Agent, or Firm*—Marshall, O'Toole, Gerstein, Murray & Bicknell

[57] ABSTRACT

A liquid level detector for detecting liquid level height in a vessel includes a housing adapted to float in the liquid, first and second spaced, fixed stops disposed in the housing, a pendulum having a end pivotally mounted in the housing wherein the pendulum is movable between the stops in response to a change in orientation of the housing due to a change in liquid level height in the vessel, an electrical switch disposed of in the housing adjacent to the first stop and actuable by the pendulum and a cable for tethering an end of the housing to the vessel.

17 Claims, 3 Drawing Sheets

LIQUID LEVEL FLOAT SWITCH

BACKGROUND OF THE INVENTION

The present invention relates to liquid level sensing devices, and more particularly to a liquid level float switch.

Liquid level sensing devices are often used to indicate the level of liquid in a vessel or other container and/or to operate flow control devices that control the liquid level. A liquid level regulator device manufactured by Flgyt Company, Sweden, under the tradename, Flgyt ENG-10, utilizes a pair of tear-drop shaped plastic bodies which are weighted according to the specific gravity of the liquid in which they are to be used. The bodies are suspended from electrical cables supported above the vessel containing the liquid. The devices are hung at different heights, corresponding to predetermined maximum and minimum liquid levels. When the container is empty, the cables hang vertically within the vessels. When the liquid rises within the vessel to a level sufficient to submerge the device, the device tilts, actuating an attitude sensitive switch within the housing of the device. The switching action is utilized to actuate a pump controller or other liquid level control device. By using this arrangement, the pump may be activated to fill the container when the liquid level drops to a predetermined minimum level and the pump may be deactivated when the level reaches a predetermined maximum level. These devices do not float in the liquid but are arranged so that their base portions are more buoyant than their neck portions which causes the tilting action of the device when finally submerged. The effect of this arrangement is that the switching action of the device is sluggish, and a positive switching action may not be obtained, particularly when there is a degree of turbulence in the liquid within the vessel.

Another disadvantage of this type of regulator device is that, as the body is being submerged, an intermediate stage is reached where the switching mechanism within the device tends to intermittently open and close several times. This is undesirable as it causes the pump motor to be switched on and off and can, as a consequence, cause damage to the pumping motor. This intermittent switching is aggravated when the device is used in industrial applications in which the liquid within the vessel is turbulent.

Reichensperger U.S. Pat. No. 3,483,341 discloses a floating switch comprising a tethered housing containing a pendulum switch. The attitude of the housing varies with the level of liquid in a well. As the attitude of the housing varies, the pendulum switch tilts downwardly or upwardly opening or closing a pair of switch contacts which, in turn activates or deactivates an immersion motor pump. It appears that the Reichensperger device also suffers from the disadvantage noted above wherein the switch rapidly oscillates between opened and closed states, thereby increasing the possibility of pump damage in turbulent conditions.

SUMMARY OF THE INVENTION

In accordance with the present invention, a liquid level float switch provides an indication of liquid level height in a vessel and may be used to control the liquid level height in a simple and economic fashion.

More particularly, the liquid level detector for detecting liquid level height in a vessel includes a housing adapted to float in the liquid, first and second spaced, fixed stops disposed in the housing, a pendulum having an end pivotally mounted in the housing wherein the pendulum is movable between the stops in response to a change in orientation of the housing due to a change in liquid level height in the vessel, an electrical switch disposed in the housing adjacent the first stop and actuable by the pendulum and means for tethering an end of the housing.

In the preferred embodiment, means are provided for releasably latching the pendulum to the first stop. Advantageously, the pendulum is made of a magnetic material and the releasable latching means comprises a magnet disposed on the first stop. Also, a magnet may be disposed on the second stop for releasably latching the pendulum thereagainst when the pendulum engages the second stop.

In accordance with a further aspect of the present invention, a liquid level regulator for regulating liquid level in a vessel between maximum and minimum levels includes a housing adapted to float in the liquid, means for tethering the housing to the vessel, first and a second spaced, fixed stops disposed in the housing and a pendulum having an end pivotally mounted in the housing wherein the pendulum is movable between the stops in a response to a change in orientation of the housing due to a change in liquid level height in the vessel. A switch is disposed in the housing adjacent the first stop and includes a pair of contacts controlled by an actuator wherein the actuator is engaged by the pendulum to open the contacts when the pendulum is in contact with the first stop and wherein the actuator is not engaged by the pendulum to thereby close the contacts when the pendulum is spaced from the first stop. Means are coupled to the switch for providing liquid to the vessel when the switch contacts are closed.

In accordance with a further aspect of the invention, the housing has two stable orientations and the pendulum is engaged with the first stop when the housing is in one of the stable orientations and is engaged with the second stop when the housing is in the other of the stable orientations.

If desired, a second switch may be provided in the housing adjacent the second stop and includes a pair of contacts controlled by an actuator wherein the actuator is engaged by the pendulum to open the second switch contacts when the pendulum is in contact with the second stop and wherein the second switch actuator is not engaged by the pendulum to thereby close the second switch contacts when the pendulum is spaced from the second stop.

The pendulum mass is sufficient to maintain the housing in one of the stable states until sufficient torque is applied by the cable against the housing to force the housing to rotate and assume the other stable orientation. When the float switch is used to provide liquid level height information to a flow controller, the controller maintains the height of the liquid between minimum and maximum level limits.

DESCRIPTION OF THE PREFERRED EMBODIMENT

Figure 1:
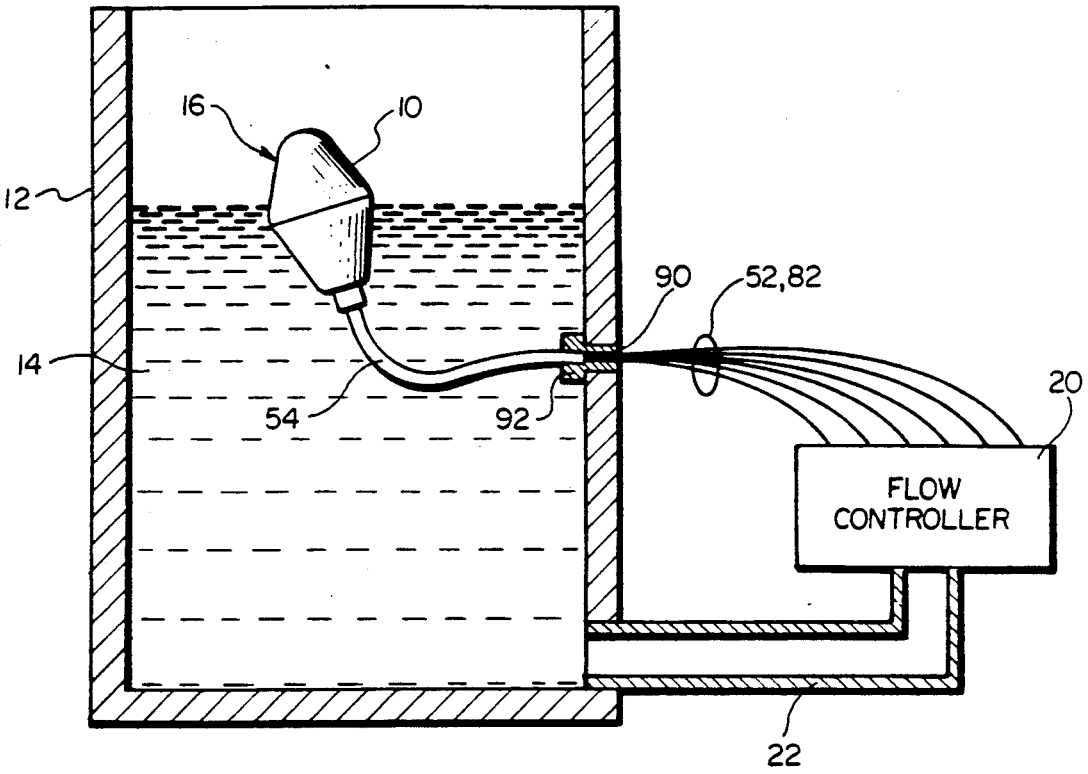
FIG. 1 comprises an elevational view, partly in section, of the liquid level float switch of the present invention disposed within a vessel together with a flow controller.

Referring now to FIG. 1, a float switch 10 according to the present invention is disposed within a vessel 12 or other container and detects the level of liquid 14 within the vessel 12. The float switch 10 includes a housing 16 made of, for example, plastic or metal which floats on the surface of the liquid 14 and develops a signal which is passed over conductors to a suitable utilization device, such as an indicator or, more preferably, a flow controller 20. The flow controller controls the admittance of liquid into the vessel 12 via piping 22 in a well-known fashion.

Figure 3:
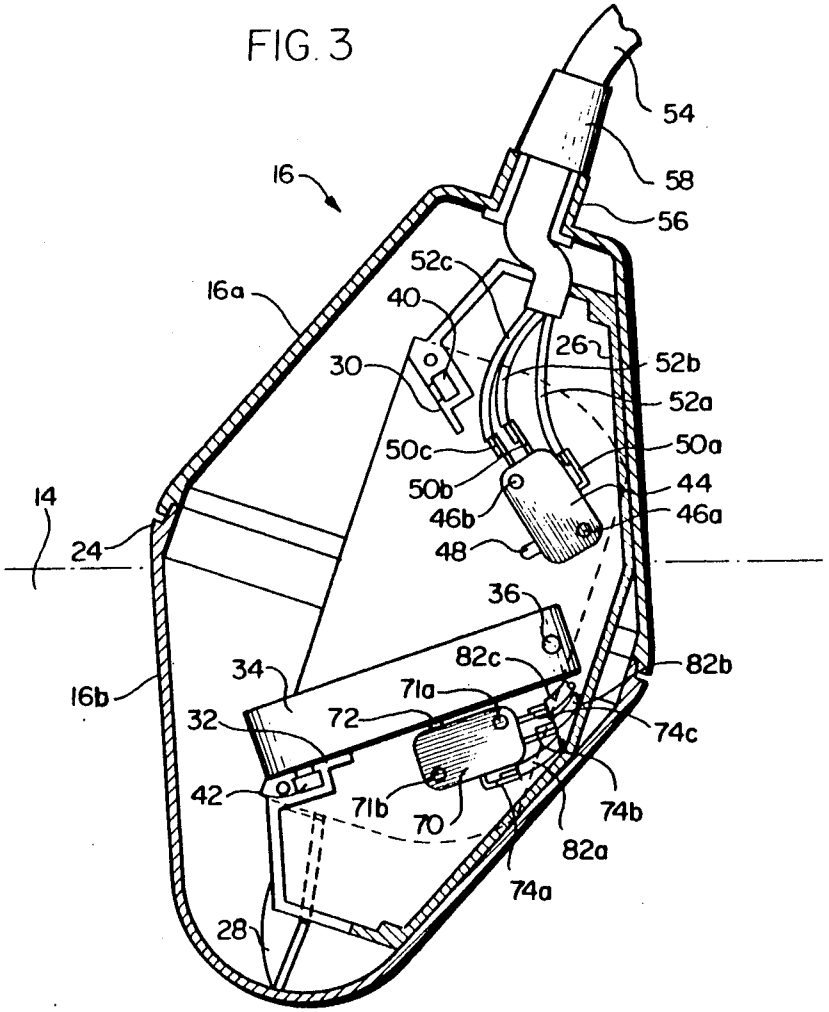
FIGS. 2 and 3 are elevational views, partly in section, illustrating the float switch of the present invention in greater detail wherein the housing is disposed in first and second stable orientations, respectively.
Figure 2:
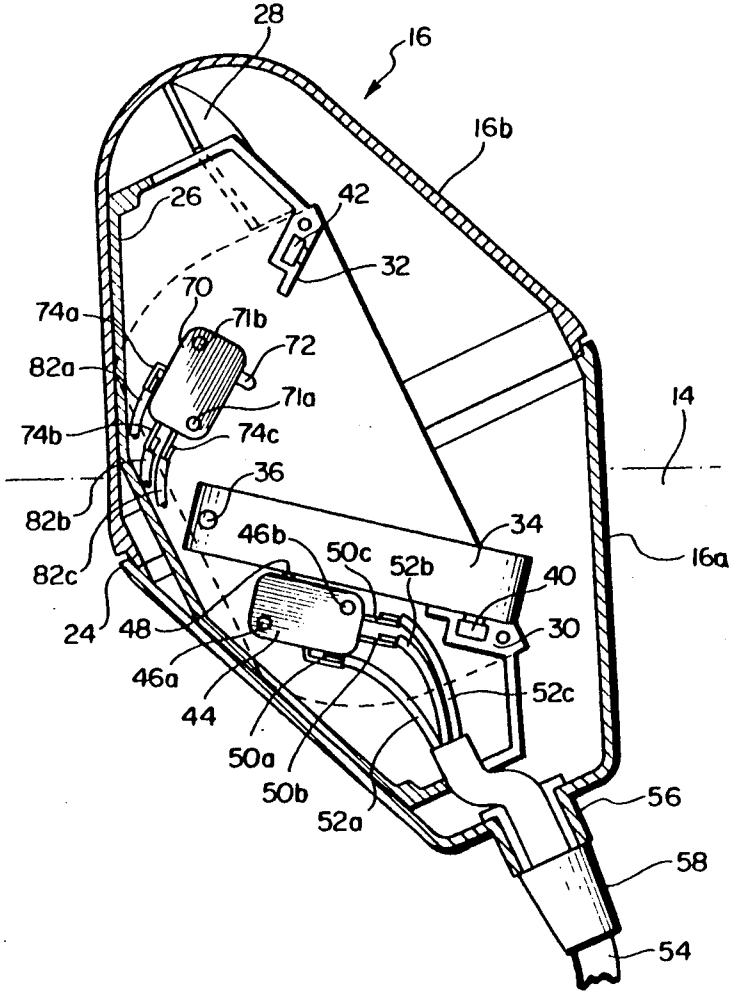

Referring now to FIGS. 2 and 3, the housing 16 is preferably liquid tight and includes first and second housing portions 16*a*, 16*b* which are joined at a mid-portion 24 by a suitable adhesive or by any other suitable means.

Disposed within the housing 16 is a carrier 26 which may be secured therein by adhesive or another suitable fastening means. The carrier is positioned within the housing 16 by a stand off 28 which may be formed integrally with the housing portion 16A.

Disposed on the carrier 26 are first and second spaced, fixed stops 30, 32.

Disposed in a space between the stops 30, 32 is a pendulum 34 which is pivotally mounted by a pivot pin 36 such that the pendulum 34 is movable in an arcuate path between the stops 30 and 32. Preferably, the pendulum 34 is made of a magnetic material having a mass sufficient to maintain the housing 16 in one of two stable orientations wherein the first stable orientation is shown in FIG. 2 and the second stable orientation is shown in FIG. 3. Magnets 40, 42 are disposed within the stops 30, 32 and are retained therein. The magnets 40, 42 releasably latch the pendulum 34 against the stops 30, 32, respectively, when the pendulum 34 engages or contacts same.

Preferably, the pendulum 34 and the stops 30, 32 are fabricated from materials which suppress bouncing of the pendulum against the stops. For example, the stops may be made of plastic or metal or another suitable shock-resistant material and the pendulum may be fabricated at least in part from cold-rolled steel or another magnetic material.

A first electrical switch 44 is disposed within the housing 16 adjacent the stop 30 and is secured to the carrier 26 by rivets or screws 46*a*, 46*b*. The switch 44 includes an actuator in the form of a plunger 48 which is depressed when the pendulum 34 is in contact with the stop 30. The switch 44 includes two, and preferably three terminals 50*a*, 50*b* and 50*c* which are electrically connected to conductors 52*a*–52*c*, respectively. The conductors 52*a*–52*c* are bundled together within a cable 54 having a liquid-tight outer covering. The cable 54 is secured by an interference fit within a bushing 56 integral with the housing portion 16*a*. A grommet 58 which extends through the bushing 56 assists in preventing the entry of liquid into the housing 16 and providing the interference fit.

Figure 6:
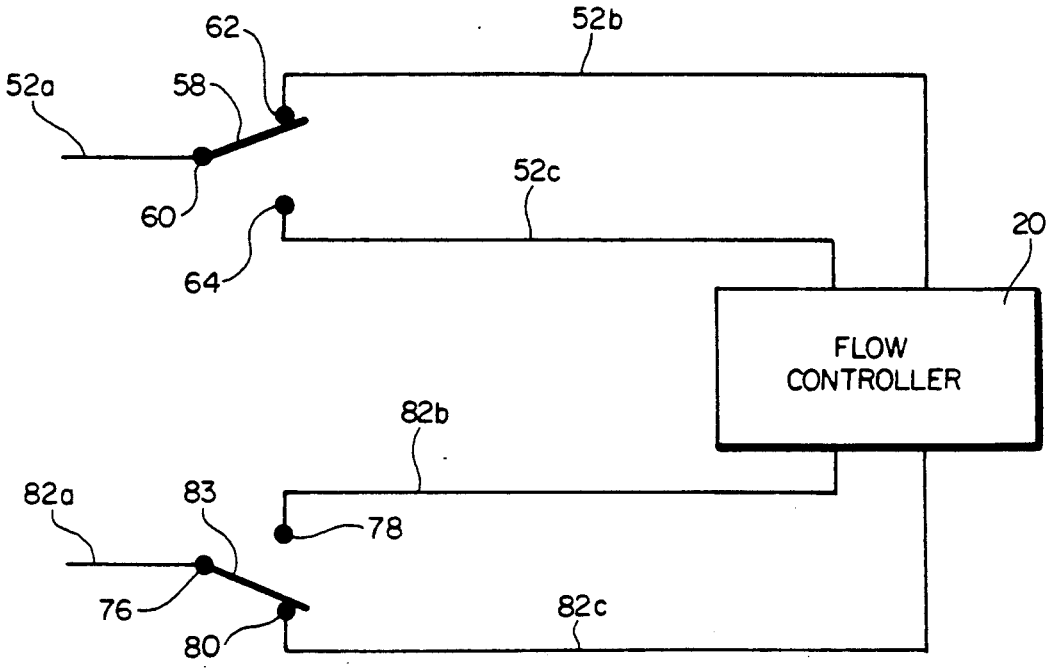
FIGS. 5A–5C are diagramatic views illustrating the transition between stable orientations of the float switch during rising liquid level and FIG. 6 is a schematic diagram of the float switch of the present invention together with a flow controller.

Referring also to FIG. 6, the actuator 48 controls the position of a wiper 58 that in turn controls the interconnection of the contacts 60, 62 and 64. The contacts 62 and 64 are connected to the flow controller 20 by the conductors 52*b*, 52*c* whereas the conductor 52*a* connects the contact 60 to a suitable source of power (not shown).

If necessary or desirable, a second switch 70 may be disposed in the housing adjacent the stop 32 and is secured to the carrier 26 by rivets or screws 71*a*, 71*b* as shown in FIGS. 2 and 3 or by any other well-known means. The switch 70 includes an actuator 72 and terminals 74*a*–74*c* that are in turn coupled to contacts 76, 78, 80, similar to the actuator 48, terminals 50*a*–50*c* and contacts 60, 62, 64 of the switch 44. The terminals 74*a*–74*c* are coupled by conductors 82*a*–82*c* that are bundled with the conductors 52*a*–52*c* in the cable 54. As seen in FIG. 6, the contact 76 may be coupled by the conductor 82*a* to a source of power where as the contacts 78 and 80 may be connected to the flow controller 20 by the conductors 82*b*, 82*c*. Alternatively, the contacts 76, 78 and 80 may be connected by the conductors 82*a*–82*c* to a different utilization device, if desired. Interconnection between the contacts 76, 78 and 80 is controlled by a wiper 83 operated by the actuator 72.

As seen in FIG. 1, the cable 54 is anchored to the wall of the vessel 12 adjacent an opening 90. A seal 92 prevents the escape of liquid into the opening 90. It should be noted that the cable 54 supplied with the float switch 10 may be of a predetermined length sufficient to allow the switch 10 to be used in vessels of a certain maximum height when an end of the cable 54 is attached to the vessel wall adjacent the opening 90. For vessels that are less than the maximum height, the length of cable 54 disposed in the vessel 12 may be shortened by attaching a selected mid-portion of the cable 54 to the vessel wall adjacent the opening 90.

The conductors 52*a*–52*c* and 82*a*–82*c* pass through the opening 90 in the vessel 12 and are coupled to the flow control 20 as previously noted.

Figure 4A:
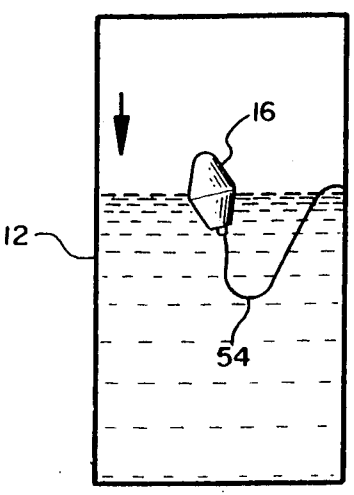
FIGS. 4A–4C are diagramatic views illustrating the transition between stable orientations of the float switch as the liquid level is dropping within the vessel.
Figure 4B:
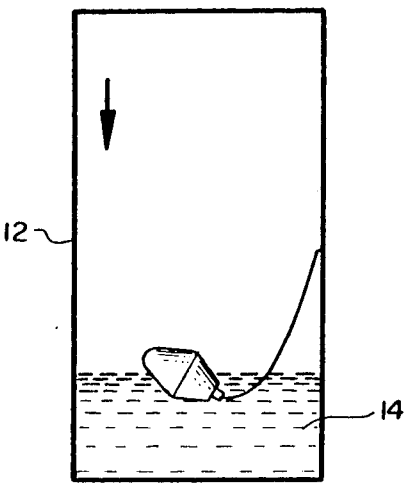
Figure 4C:
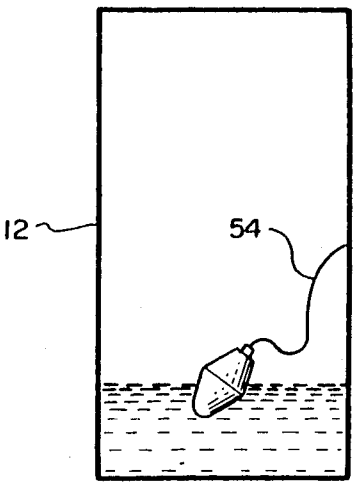

Illustrated in FIGS. 4A–4C is a situation wherein the level of the liquid 14 in the vessel 12 is dropping, as indicated by the downwardly directed arrow. Further, it is assumed that the housing 16 is in the first stable orientation illustrated in FIG. 2. As the liquid level drops, the cable 54, which acts as a tether, begins to exert a torque or turning moment on the housing 16 due to the spacing of the housing 16 from the anchor point of the cable 54 with the vessel 12. At this time, the pendulum 34 is in contact with the stop 30 and is latched thereto by the magnet 40. As liquid level continues to drop, the housing 16 eventually assumes the position shown in FIG. 4B intermediate the stable orientations. At this time, the pendulum 34 remains in contact with the stop 30 due to the attractive force exerted by the magnet 40. However, as liquid level continues to drop to the level shown in FIG. 4C, the weight of the pendulum 34 overcomes the attractive force exerted by the magnet 40, in turn causing the pendulum 34 to swing into contact with the stop 32. This, in turn, causes the housing 16 to assume the second stable orientation illustrated in FIG. 3. At this time, the actuator 48 is released, thereby causing the wiper 58 to disconnect the contact 60 from the contact 62 and to connect the contact 60 to the contact 64.

In addition to the foregoing, engagement of the pendulum 34 with the stop 32 causes latching of the pendulum 34 thereto due to the magnetic force exerted by the magnet 42. The actuator 72 of the switch 70 is also depressed at this time, causing the contact 76 to be connected to the contact 78 by the wiper 83.

Figure 5A:
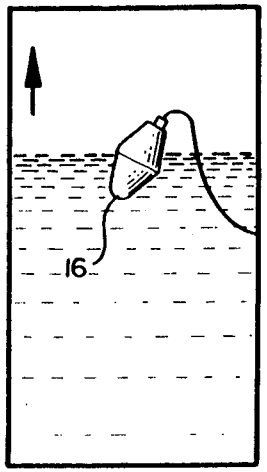
Figure 5B:
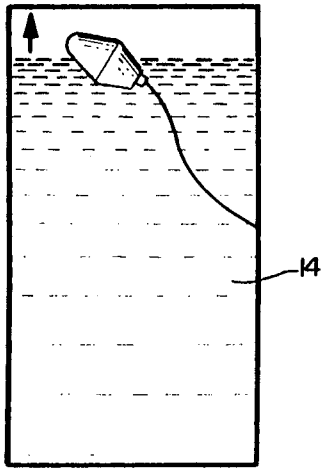
Figure 5C:
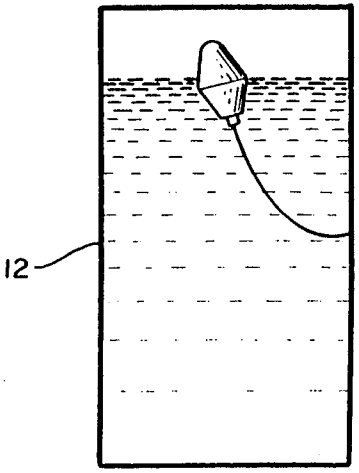

During the sequence illustrated in FIGS. 4A and 4B and up until the time the second stable orientation is assumed as shown in FIG. 4C, the flow controller is commanded to remain off and not replace the liquid exiting the vessel 12. Upon assuming the second stable position of FIG. 4C, deactuation of the switch 44 and actuation of the switch 70 in turn causes connection of the contact 60 to the contact 64 and connection of the contact 76 to the contact 78 so that the flow controller is commanded to provide a flow of liquid to the vessel 12. As seen FIGS. 5A–5C, the housing 16 remains in the second stable orientation until, as seen in FIG. 5B, the cable 54 exerts a torque or turning moment on the housing 16. In the position illustrated in FIG. 5B, the magnet 42 causes the pendulum 34 to remain in contact with the stop 32 until the weight of the pendulum 34 overcomes the magnetic force exerted by the magnet 42. At this time, the pendulum 34 again swings into contact with the stop 30, thereby deactuating the switch 44 and actuating the switch 70.

As the foregoing discussion demonstrates, the pendulum is weighted to act as a ballast which, in the absence of forces exerted by the cable 44, keeps the housing 16 in one of two stable orientations.

As should be evident, the length of the cable and its point of attachment with the vessel wall may be varied to control the levels at which the flow controller is commanded to turn on and turn off liquid flow.

In the embodiment illustrated in the figures, the switch 70 acts as a backup to the switch 44 to provide a redundant command to the flow controller 20 to begin or terminate flow of liquid into the vessel 12. If desired, the second switch 70 may be dispensed with, in which case only the switch 44 provides this command function. Also, the particular form of the switch as illustrated in the figures may be replaced by a different type of switch if desired.

It should also be noted that one or both of the magnets 40, 42 need not be used to obtain latching of the pendulum 34 to the stops 30, 32. Further, the releasable latching of the pendulum 34 against the stops 30, 32 may be accomplished in a different manner. For example, the pendulum 34 may carry a magnet and a body of magnetic material may be secured to each stop 30, 32. The pendulum may in fact be made of plastic and filled with sand or another material and may carry a magnet or a body of magnetic material, as desired. Alternatively, other types of mechanical latching means may be used in place of the magnetic latching arrangement described herein.

As the foregoing description demonstrates, a single liquid level detector may be utilized to control both maximum and minimum liquid levels within a container. The switching action of the detector 10 of the present invention is rapid and positive. Further, the switches 44, 70 will not be subjected to rapid and intermittent changes in states which might damage the flow controller 20.

Further modifications and alternative embodiments of the invention will be apparent to those skilled in the art in view of the foregoing description. Accordingly, this description is to be construed as illustrative only, and is for the purpose of teaching those skilled in the art the best mode of carrying out the invention. The details of the structure may be varied substantially without departing from the spirit from the invention, and the exclusive use of all modifications which come within the scope of the appended claims is reserved.

What is claimed is:

1. A liquid level detector for detecting liquid level height in a vessel, comprising:

a housing adapted to float in the liquid;

first and second spaced, fixed stops disposed in the housing;

a pendulum having an end pivotally mounted in the housing wherein the pendulum is movable between stops in response to a change in orientation of the housing due to a change in liquid level height of the vessel;

an electrical switch disposed in the housing adjacent the first stop having an actuator separate from the pendulum and actuable thereby; and means for tethering an end of the housing.

2. The liquid level detector of claim 1, further including means for releasably latching the pendulum to the first stop.

3. The liquid level detector of claim 2, wherein the pendulum is made of a magnetic material and wherein the releasable latching means comprises a magnet disposed on the first stop.

4. The liquid level detector of claim 3, further including a magnet disposed on the second stop for releasably latching the pendulum thereagainst.

5. The liquid level detector of claim 2, wherein the switch includes contacts that are opened when the pendulum is latched to the first stop and closed when the pendulum is released from the first stop.

6. The liquid level detector of claim 5, wherein the tethering means comprises an electrical cable having first and second ends and a mid-portion wherein the first end is connected by a water tight seal to the housing and provides conductors for connection to the switch and the second end of the cable or a selective portion of the mid-portion of the cable is anchored to a wall of the vessel.

7. The liquid level detector of claim 6, wherein the actuator of the switch is displaced by the pendulum when the pendulum is engaged with the first stop, and wherein the switch includes a pair of contacts controlled by the actuator and terminals connected to the contacts and to the conductors.

8. The liquid level detector of claim 1, including a second switch mounted adjacent the second stop and actuable by the pendulum.

9. The liquid level detector of claim 8, wherein the second switch includes an actuator that is displaced by the pendulum when the pendulum is engaged with the second stop, a pair of contacts controlled by the actuator and terminals connected to the contacts of the second switch and to the conductors.

10. The liquid level detector of claim 6, wherein the length of the cable defines maximum and minimum fluid levels in the vessel and wherein the second end of the cable or a selective portion of the mid-portion of the cable is anchored on the vessel midway between the maximum and minimum fluid levels.

11. A liquid level regulator for regulating liquid level in a vessel between maximum and minimum levels, comprising:

a housing adapted to float in the liquid;

means for tethering the housing to the vessel;

first and second spaced, fixed stops disposed in the housing;

a pendulum having an end pivotally mounted in the housing wherein the pendulum is movable between the stops in response to a change in orientation of the housing due to a change in liquid level height in the vessel;

a switch in the housing adjacent the first stop having a pair of contacts controlled by an actuator, said switch being separate from the pendulum and actuable thereby wherein the actuator is engaged by the pendulum to open the contacts when the pendulum is in contact with the first stop and wherein the actuator is not engaged by the pendulum to thereby close the contacts when the pendulum is spaced from the first stop; and means coupled to the switch for providing liquid to the vessel when the switch contacts are closed.

12. The liquid level regulator of claim 11, wherein the housing has two stable orientations and wherein the pendulum is engaged with the first stop in one of the stable orientations and is engaged with the second stop in the other of the stable orientations.

13. The liquid level regulator of claim 11, further including a second switch in the housing adjacent the second stop.

14. The liquid level regulator of claim 13, wherein the second switch includes a pair of contacts controlled by an actuator wherein the actuator is engaged by the pendulum to open the second switch contacts when the pendulum is in contact with the second stop and wherein the second switch actuator is not engaged by the pendulum to thereby close the second switch contacts when the pendulum is spaced from the second stop.

15. The liquid level regulator of claim 11, further including means for releasably latching the pendulum to the first and second stops.

16. The liquid level regulator of claim 15, wherein the pendulum is made of magnetic material and wherein the releasable latching means comprises first and second magnets secured to the first and second stops, respectively.

17. The liquid level regulator of claim 11, wherein the pendulum is weighted to act as a ballast for the housing.

* * * * *